US005244419A

United States Patent [19]

Ju

[11] Patent Number: 5,244,419

[45] Date of Patent: Sep. 14, 1993

[54] ELECTRONIC CONNECTOR

[76] Inventor: Ted Ju, 18, Lane 30, Syh Wei Rd., Wu Gu Hsiang, Taipei Hsien, Taiwan

[21] Appl. No.: 980,927

[22] Filed: Nov. 24, 1992

[51] Int. Cl.[5] ..... H01R 13/502

[52] U.S. Cl. ..... 439/686; 439/289

[58] Field of Search ..... 439/686, 688, 689, 690, 439/695, 701, 289, 290

[56] References Cited

U.S. PATENT DOCUMENTS

| | | | |
|---|---|---|---|
| 3,440,596 | 4/1969 | Frompovicz | 439/695 |
| 4,392,699 | 7/1983 | Weingartner | 439/686 |
| 4,641,909 | 2/1987 | Steffinger | 439/686 |
| 4,764,130 | 8/1988 | DiClemmente | 439/686 |

FOREIGN PATENT DOCUMENTS

| | | | |
|---|---|---|---|
| 3318135 | 11/1984 | Fed. Rep. of Germany | 439/78 |

*Primary Examiner*—P. W. Echols

*Attorney, Agent, or Firm*—Wenderoth, Lind & Ponack

[57] ABSTRACT

An electronic connector has two terminal holders covered by two opposite outer shells, a first set of terminals positioned in terminal holes in one terminal holder, and a second set of terminals positioned in terminal holes in the other terminal holder and respectively contacting the first set of terminals. The terminals of the first set each have a flat, elongate connecting strip respectively abutting flat, elongate connecting strips of each of the terminals of the second set and oriented at right angles thereto.

2 Claims, 4 Drawing Sheets

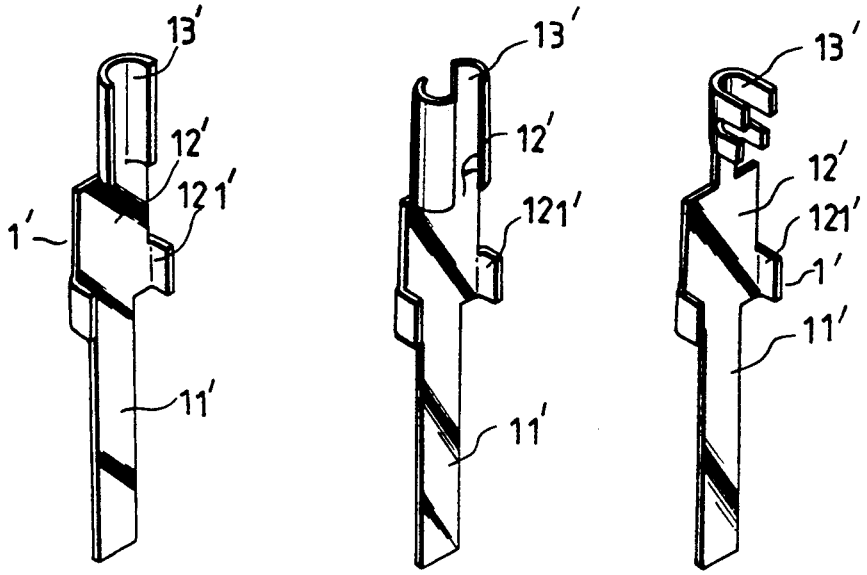
FIG, 3
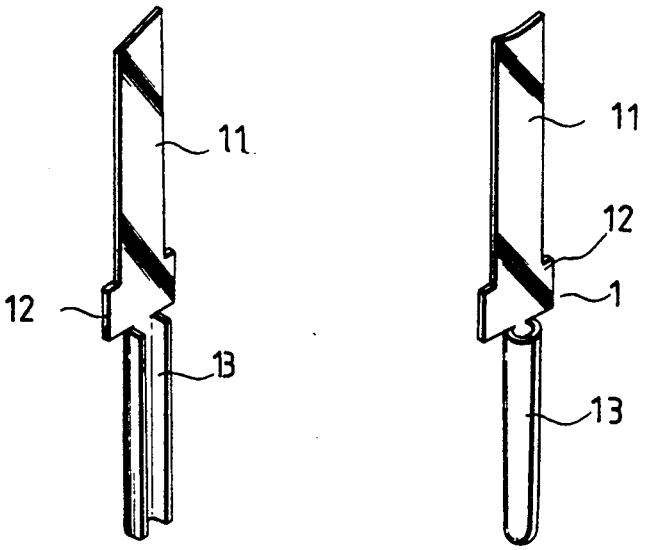
FIG, 2

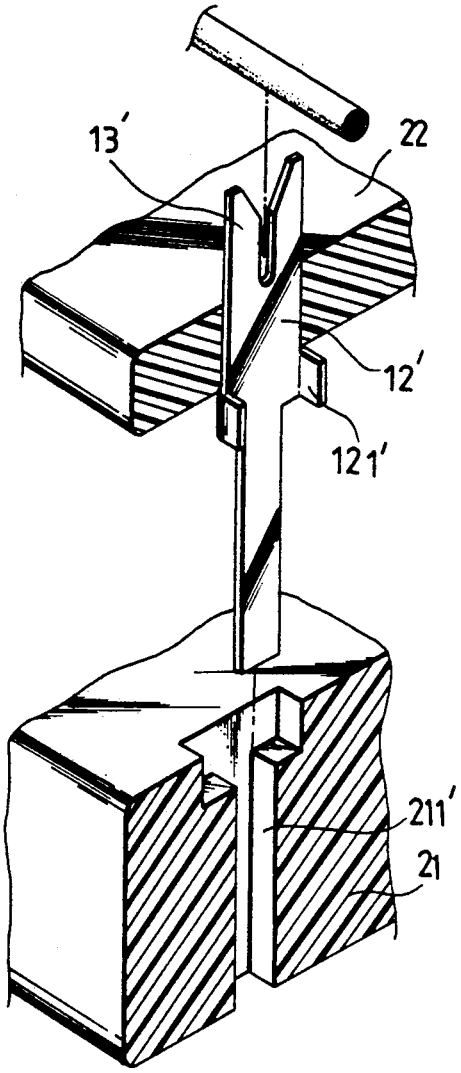
FIG, 5
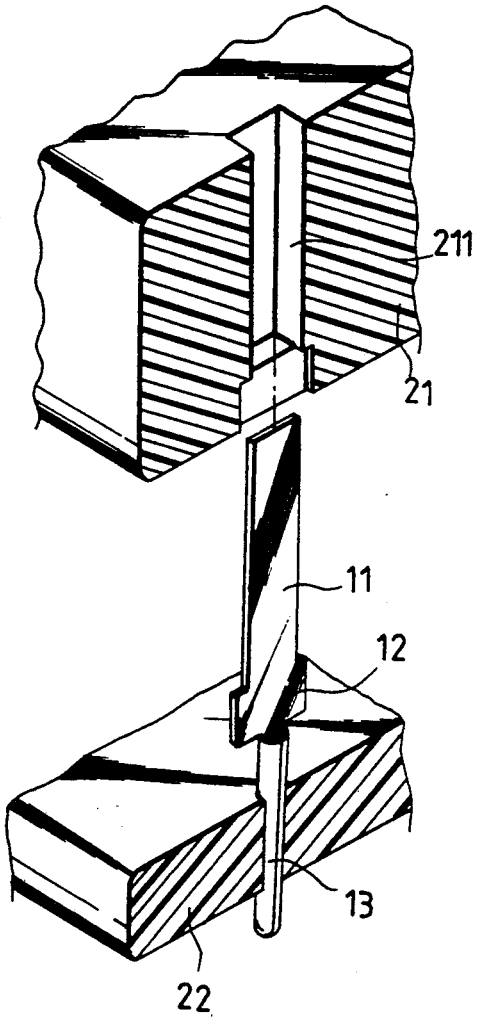
FIG, 4

ELECTRONIC CONNECTOR

BACKGROUND OF THE INVENTION (a) Field of the Invention

The present invention relates to electronic connectors and relates more particularly to an electronic connector consisting of two end-matched sets of terminals respectively abutting each other at right angles in positive contact.

(b) Description of the Prior Art

Various electronic connectors are known and used for different purposes. An electronic connector of the type having a male connecting part and a female connecting part joined together generally comprises two sets of tubular terminals respectively fastened to the male and female connecting parts and then connected together through plug-in joints. Because the two sets of tubular terminals are to be respectively connected through plug-in joints, the precision in their manufacture is critical. Therefore, the manufacturing process of the tubular terminals is relatively complicated. Because of the complicated manufacturing process, the manufacturing cost of this type of electronic connector is high.

SUMMARY OF THE INVENTION

The present invention eliminates the aforesaid disadvantages. It is therefore an object of the present invention to provide an electronic connector which is easy and inexpensive to manufacture. It is another object of the present invention to provide an electronic connector which is easy to assemble. According to the present invention, the two opposite sets of terminals have portions which contact and are oriented at right angles to one another. Therefore, the precision of the specifications of the terminals is less critical.

BRIEF DESCRIPTION OF THE DRAWINGS

FIG. 2 illustrates a terminal according to the present invention;

FIG. 3 illustrates alternate forms of the terminal

FIG. 4 is an exploded sectional view of a terminal holder according to the present invention;

DETAILED DESCRIPTION OF THE PREFERRED EMBODIMENT

Figure 1:
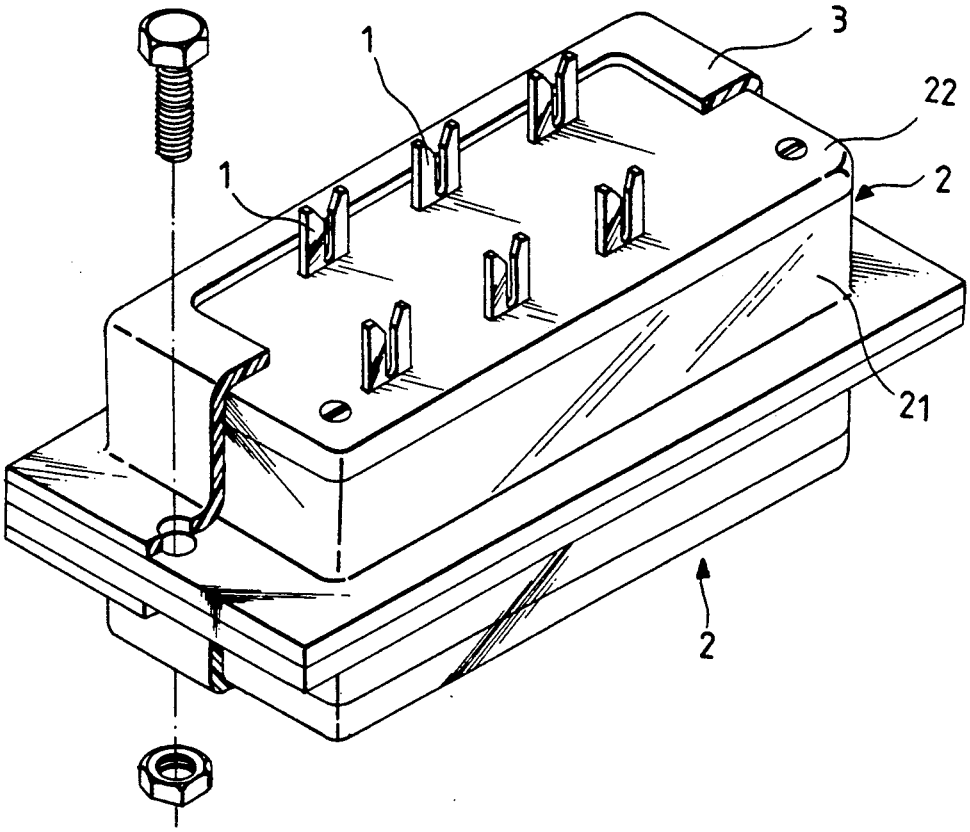
FIG. 1 is a perspective view of an electronic connector according to the present invention.

Referring to FIG. 1, an electronic connector as constructed in accordance with the present invention generally comprises a plurality of terminals 1, two terminal holders 2, and two outer shells 3 respectively covering the terminal holders 2. The outer shells 3 are made according to conventional techniques and do not form part of the present invention per se. The main characteristics of the present invention are associated with the terminals 1 and the terminal holders 2.

Referring to FIGS. 2 and 3, the terminals 1 are respectively made from a narrow, elongate, resilient, strip of conductive metal. As illustrated in FIG. 2, each terminal 1 has one end formed into a flat, elongate connecting strip 11, an opposite end formed into a channeled or tubular contact 13, and a middle part formed into a flat wing portion 12 interposed between the elongate connecting strip 11 and the contact 13. The structure of the terminals 1 may be variously embodied. In FIG. 3, the terminal 1' also comprises a flat, elongate connecting strip 11' and a contact 13' joined by an intermediate wing portion 12'. The wing portion 12' of the terminal 1' in FIG. 3 has two parallel projections 121' extending perpendicularly to the longitudinal axis of the terminal from two opposite sides thereof. The contact 13' of the terminal 1' in FIG. 3 may be made in the shape of a U-channel, two opposing U-channels, or a semi-circular canal. In FIG. 5, the contact 13' of the terminal 1' has a terminal portion in the shape of a fork.

Referring to FIGS. 4 and 5, each terminal holder 2 consists of a base 21 and a cover 22. The base 21 has stepped terminal holes 211 (211') into which the flat, elongate connecting strip 11 of either terminal 1 fits. Each stepped terminal hole 211 (211') has a wider top end (adjacent to the cover 22) for positioning the wing portion 12 of either terminal 1 (see FIG. 4) or the wing portion 12' with its parallel projections 121' (see FIG. 5). The cover 22 has terminal holes (not shown) respectively aligned with the stepped terminal holes 211 on the base 21, through which the contact 13 of either terminal 1 extends.

Figure 6:
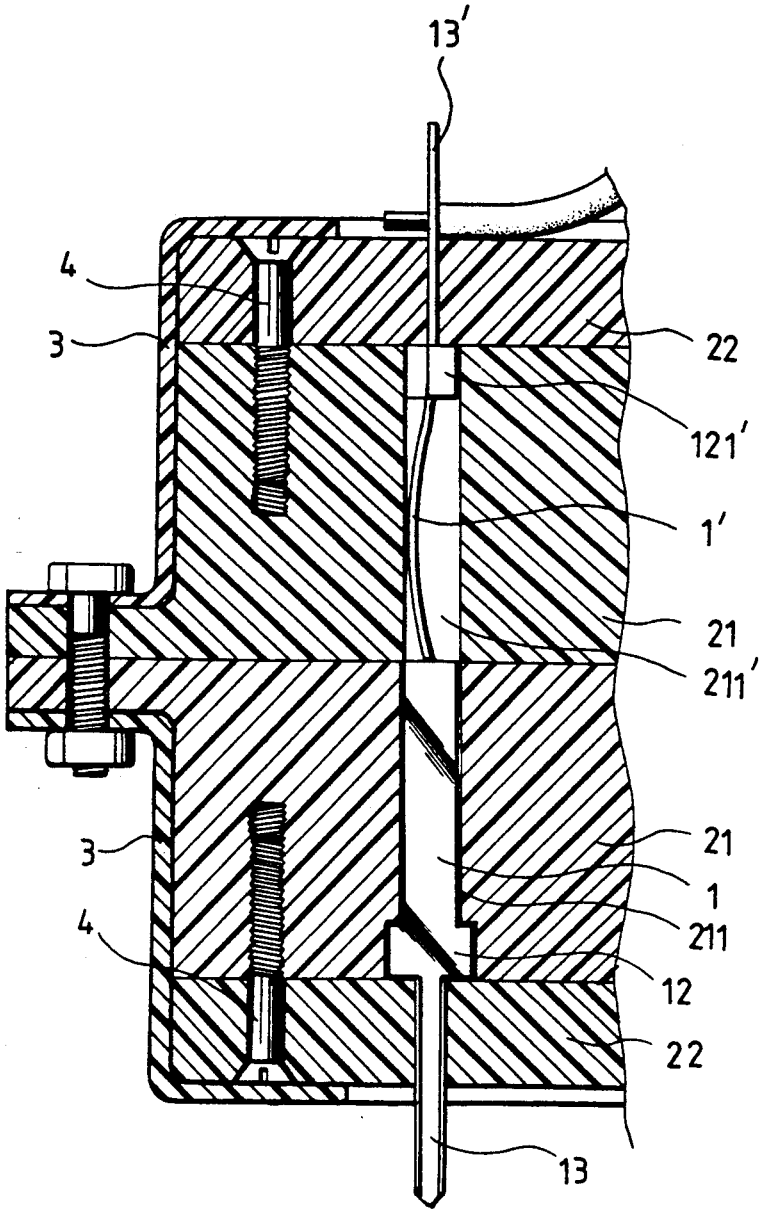
FIG. 6 is a sectional view of a portion of the electronic connector.

Referring to FIG. 6, the terminal holes 211 in the base 21 of one terminal holder are longitudinally and respectively aligned with the terminal holes 211' in the base 21' of the other terminal holder and become oriented at right angles to one another as the two terminal holders 2 and the two outer shells 3 are fastened together by screws 4. Therefore, the terminals 1 in the terminal holder are respectively abutted against the terminals 1' in the other terminal holder at right angles through end-matched joints, namely, the terminals 1' in one terminal holder are respectively and resiliently engaged with the terminals 1 in the other terminal holder so as to be in positive contact therewith.

Figure 7:
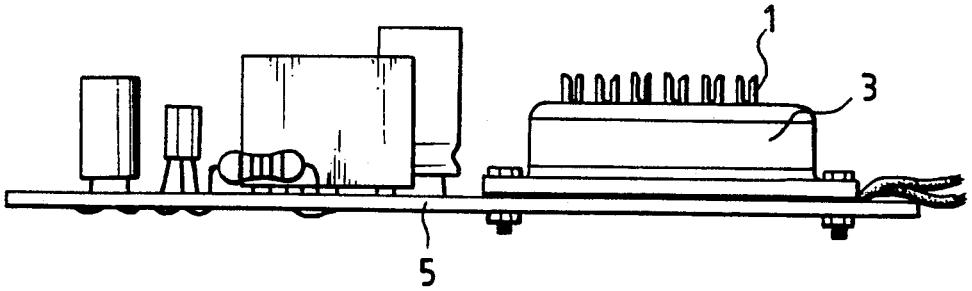
FIG. 7 illustrates an alternate form of the electronic connector.

FIG. 7 illustrates an alternate form of the present invention. In this alternate form, the electronic connector consists of one terminal holder 2, one outer shell 3, and a set of terminals 1. As illustrated, the outer shell 3 is directly fastened to a printed circuit board 5 to hold the terminal holder 2 in place with the connecting strip of each terminal respectively connected to the circuit of the printed circuit board 5.

What is claimed is:

1. An electronic connector comprising: two terminal holders disposed bottom-to-bottom, each of said terminal holders having terminal holes extending therethrough; two opposite outer shells covering said terminal holders, respectively; a first set of terminals positioned in the terminal holes in one of said terminal holders; a second set of terminals positioned in the terminal holes in the other of said terminal holders and respectively contacting said first set of terminals; each of said terminals having a first end in the form of a flat, elongate connecting strip, an opposite second end in the form of a channeled, forked or tubular contact, and a middle part in the form of a wing interposed between the elongate connecting strip and the contact; the wing of each of said terminals positioning the terminal within its respective terminal holder; the flat, elongate connecting strip of each of said first set of terminals abutting end-to-end with and being oriented at right angled to the flat, elongate connecting strip of a respective one of said second set of terminals; each of said terminal holders consisting of a base and a top cover, the base having stepped terminal holes therein constituting parts of said terminal holes extending through the terminal holder, the respective top cover having terminal holes therein aligned with the stepped terminal holes and constituting other parts of the terminal holes extending through the terminal holder; each of the stepped terminal holes having an axially extending portion, and a wider top portion which receives and positions the wing of a respective one of the terminals; the axially extending portions of the terminal holes in the base of one of said terminal holders being in axial alignment with and open to the axially extending portions of the terminal holes in the base of the other of said terminal holders, respectively; and the wider top portions of the terminal holes in the base of one of said terminal holders being oriented at right angles to the wider top portions of the terminal holes in the base of the other of said terminal, respectively.

2. The electronic connector of claim 1 wherein the wing portion of each terminal has two parallel projections perpendicularly extended from two opposite sides thereof.

* * * * *